US006537425B2

(12) United States Patent
Rheims et al.

(10) Patent No.: US 6,537,425 B2
(45) Date of Patent: Mar. 25, 2003

(54) PROCESS FOR LOADING FIBERS WITH CALCIUM CARBONATE

(75) Inventors: Jörg Rheims, Heidenheim (DE); Klaus Doelle, Menasha, WI (US); Oliver Heise, Menasha, WI (US); Werner Witek, Appleton, WI (US)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/903,003

(22) Filed: Jul. 11, 2001

(65) Prior Publication Data

US 2002/0026989 A1 Mar. 7, 2002

(30) Foreign Application Priority Data

Jul. 13, 2000 (DE) ..... 100 33 979

(51) Int. Cl.[7] ..... D21H 17/64

(52) U.S. Cl. ..... 162/181.4; 162/9; 162/181.1; 162/183

(58) Field of Search ..... 162/9, 181.1, 181.2, 162/181.4, 183, 182

(56) References Cited

U.S. PATENT DOCUMENTS

| | | | | |
|---|---|---|---|---|
| 5,096,539 A | | 3/1992 | Allan | 162/9 |
| 5,174,861 A | * | 12/1992 | White et al. | 162/57 |
| 5,223,090 A | | 6/1993 | Klungness et al. | 162/9 |
| 5,476,711 A | * | 12/1995 | Hebbard et al. | 428/283 |
| 5,665,205 A | | 9/1997 | Srivatsa et al. | 162/181.4 |
| 5,679,220 A | | 10/1997 | Matthew et al. | 162/181.4 |
| 6,264,794 B1 | | 7/2001 | Neumann et al. | 162/205 |
| 6,355,138 B1 | * | 3/2002 | Doelle | 162/9 |

FOREIGN PATENT DOCUMENTS

| | | | |
|---|---|---|---|
| EP | 0 457 235 A1 | 11/1991 | D21H/17/70 |
| EP | 0 791 685 A2 | 8/1997 | D21H/17/70 |
| GB | 2 265 916 A | 10/1993 | D21H/15/02 |
| WO | WO 97/01670 | 1/1997 | D21H/17/67 |

OTHER PUBLICATIONS

Klungness, J.H., et al.: Fiber loading: Progress Report. In: Recycling Symposium Proceedings (Tappi), May 15–18, 1994, S. 283–290, AN 94:3519 Paperchem2.

* cited by examiner

*Primary Examiner*—Dean T. Nguyen
(74) *Attorney, Agent, or Firm*—Taylor & Aust, P.C.

(57) ABSTRACT

During the chemical process of loading with calcium carbonate fibers contained in a pulp suspension, a medium containing calcium oxide or calcium hydroxide is added to the pulp suspension. This treated pulp suspension is charged in at least one reactor with pure carbon dioxide (or a medium containing carbon dioxide), which, during the progression of the reaction, converts at least a significant portion of the starting materials (calcium oxide and/or calcium hydroxide and carbon dioxide) into the reaction products, calcium carbonate and water. This reaction is accomplished by properly controlling the pulp suspension's pH.

13 Claims, 3 Drawing Sheets

PROCESS FOR LOADING FIBERS WITH CALCIUM CARBONATE

BACKGROUND OF THE INVENTION

1. Field of the Invention

The present invention involves the loading of calcium carbonate into fibers contained in a pulp suspension.

2. Description of the Related Art

Pulp suspensions are used especially in paper and cardboard manufacture. The sparing use of raw material resources, due especially to economical and ecological concerns, is reflected in the paper production industry by the use of paper webs with lower basis weights, as well as by the partial replacement of pulp with filling materials. If lower cost raw materials are used, the paper quality should at least be maintained. Among other things, the end product's strength, visual characteristics, and processability play key roles in this challenge.

SUMMARY OF THE INVENTION

The present invention relates to the further optimization of the paper production process, especially with regard to achieving the greatest possible profitability and the highest possible pulp suspension quality.

The invention, in one form thereof, comprises a process of adding to the pulp suspension a medium containing calcium oxide and/or calcium hydroxide. The pulp suspension subjected to this treatment is additionally charged in at least one reactor with pure carbon dioxide or a medium containing carbon dioxide. During the course of the chemical reaction, at least a significant portion of the above-mentioned starting materials (calcium oxide and/or calcium hydroxide and carbon dioxide) is converted into the reaction products of calcium carbonate and water. This conversion is achieved by accordingly controlling the pulp suspension's pH.

The pH can be measured at one or several locations during execution of the process. The pulp suspension is further characterized by a material density (i.e., consistency) greater than 5%, and preferably between 15% and 40%. The density is also controllable within this range.

The addition of a medium containing calcium oxide and/or calcium hydroxide results in an exothermic reaction. Liquid calcium hydroxide (lime milk) is preferable for this application. That the reaction is exothermic in nature means that the water settled in or on the pulp suspension's fibrous material is not necessarily required to start and continue the chemical reaction. Significantly greater profitability and higher quality pulp suspension are achieved as a result of this reaction.

During loading of the fibers, calcium carbonate is deposited onto the wetted fiber surfaces through the addition of calcium oxide and/or calcium hydroxide to the moist fibrous material, whereby at least a portion of this calcium compound can associate with the water in the fibrous material. After this treatment, the fibrous material is charged with the pure carbon dioxide or with the medium containing carbon dioxide. Moreover, the $CaCO_3$ that is formed can create a suspension around the fibers. Accordingly, the fibers are loaded with the filling material calcium carbonate, whereby deposition onto the wetted fibrous surfaces is performed according to a so-called "Fiber Loading™ Process", as described in document U.S. Pat. No. 5,223,090. During this "Fiber Loading™ Process", $Co_2$ reacts with calcium hydroxide to form water and calcium carbonate.

The term "wetted fiber surface" can include the wetted surfaces of all individual fibers. This applies especially to cases where the fibers are loaded with calcium carbonate on their external as well as on their inner surfaces (lumen).

A preferred version of the invention process compares the respective pH value with a corresponding preset value and minimizes or eliminates the control deviation through manipulation of at least one of the following process variables:

Length of time pulp suspension remains in the reactor;

Pulp suspension feed rate;

Carbon dioxide pressure;

Temperature of the pulp suspension and/or the calcium compound;

Pressure inside the reactor;

Temperature of the $CO_2$;

Pressure of the $CO_2$;

Concentration of $CO_2$ in the medium;

Concentration of the CaO, the $Ca(OH)_2$, and the fibers; and

Specific fiber surface area.

It is advantageous to maintain control of the pulp suspension pH within a range of about 5.5 to 10.5.

It is also advantageous when the pulp suspension's ash content is controllable within a range of about 1% to about 70%.

It is preferable to feed the carbon dioxide in a gaseous state. Further, the temperature of the fed carbon dioxide can be adjusted or controlled within a range of about 10° C. to about 250° C.

In certain cases, it is also advantageous to use other visual characteristics such as brightness, light scattering properties, opacity, color location, and the light dispersion coefficient as indicators of the status of the chemical reaction.

The pH should be measured during at least one of the following steps: at least before and after the reaction; during the reaction; and possibly multiple measurements throughout (optional).

It is preferable to measure the pH at the end of the chemical reaction or following the enlargement of the specific surface area, such enlargement being achieved by using as least one fluffer.

The pressure can be controlled within the range of about 0.1 to about 20 bar.

Furthermore, the pulp suspension is subjected to shearing force, preferably in at least one fluffer, in order to enlarge its specific surface area, among other things.

Furthermore, loading the fibers with calcium carbonate can be accomplished as described in document U.S. Pat. No. 5,223,090, the contents of which are hereby incorporated by reference.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
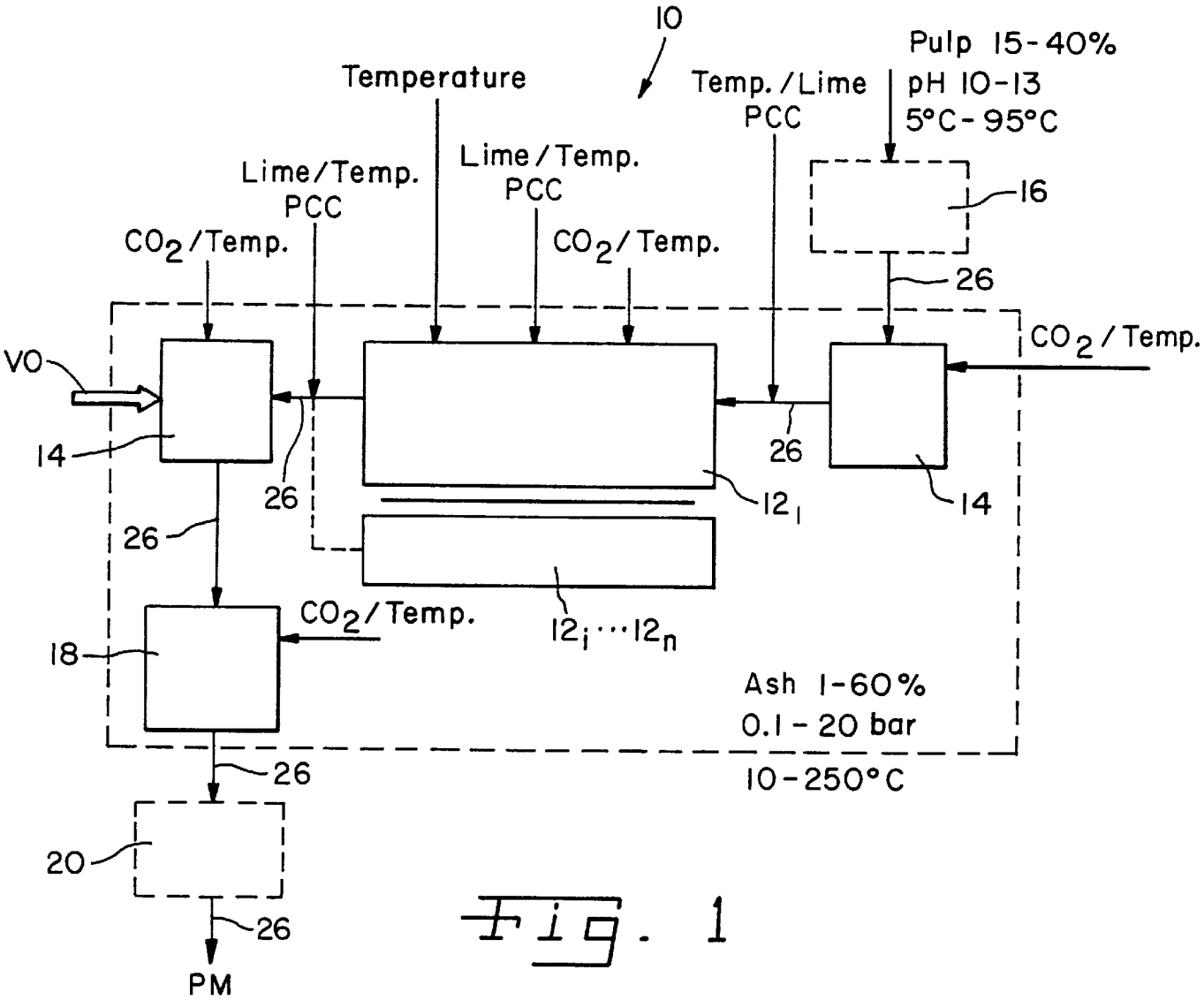
FIG. 1 is a schematic drawing of an apparatus for loading with calcium carbonate fibers contained in a pulp suspension.

FIG. 1 is a schematic depiction of an exemplary apparatus 10 for loading with calcium carbonate ($CaCO_3$) fibers contained in a pulp suspension. Accordingly, apparatus 10 serves to deposit calcium carbonate onto the wetted fibrous surfaces of the fiber material. In principle, loading of the fibers can be accomplished according to the previously-mentioned "Fiber Loading™ Process.

Apparatus 10 can include one or several reactors $\mathbf{12}_x$, in which the pulp suspension (loaded with calcium oxide (CaO) and/or calcium hydroxide ($Ca(OH)_2$) can be charged with pure carbon dioxide ($CO_2$) or with a medium containing carbon dioxide ($CO_2$).

One fluffer 14 can be provisioned before and/or after and/or in each of reactor or reactors $\mathbf{12}_x$ in which the pulp suspension's fibrous material is split with the goal of enlarging the fibrous material's specific surface area in order to optimize access for the reaction products to the fibrous material surface. This surface area enlargement further improves homogenization, and the "Fiber Loading™" process is accordingly optimized.

This surface area enlargement can occur by subjecting the pulp suspension to shearing forces (in a fluffer, for example). The pH measurement location can be at least before and after the reaction; during the reaction; and/or, optionally, at multiple measurement sites throughout the process. The pH measurement is performed preferably at the end of the reaction after enlargement of the specific surface area of the fibers.

In the following example, furst fluffer 14 is placed between refiner 16 and reactor(s) $\mathbf{12}_x$. Alternatively or additionally, fluffer 14 may be placed between at least one reactor $\mathbf{12}_x$ and tank 18. In the given example, another refiner 20 follows tank 18, which is followed by a paper machine PM.

Additional information contained in FIG. 1 is intended to serve strictly as an example and can be used individually or in a desired combination.

Apparatus 10 can therefore be used to achieve deposition of calcium carbonate onto the wetted fibrous surface of the fiber material, whereby this loading of fiber can proceed according to the previously mentioned "Fiber Loading™" process.

During the process, the medium containing calcium oxide and/or calcium hydroxide (slaked lime) can be added to the fibrous material in such a way that at least a portion of the medium can associate with the water present between the fibers, in the hollow fibers, and in their walls, resulting in the following chemical reaction:

$$\underset{\text{lime slaking}}{CaO + H_2O} \longrightarrow \underset{\text{slaked lime}}{Ca(OH)_2}$$

The fibrous material is then charged in the appropriate reactor with carbon dioxide ($CO_2$) in such a way that calcium carbonate ($CaCO_3$) is deposited as widely as possible onto the wetted fibrous surfaces. This is represented by the following chemical reaction:

$$\text{"Fiber Loading"}: Ca(OH)_2 + CO_2 \longrightarrow \underset{\text{(calcium carbonate + water)}}{CaCO_3 + H_2O}$$

Using apparatus 10, the "Fiber Loading" process continues by adding a medium containing calcium oxide and/or calcium hydroxide to the pulp suspension. This pulp suspension is charged with a pure carbon dioxide medium or a medium containing carbon dioxide and during the chemical reaction at least a significant portion of the starting products, calcium oxide and/or calcium hydroxide and carbon dioxide, are converted to the reaction products calcium carbonate and water. This is accomplished by appropriately controlling the pH.

It is thereby advantageous to compare the current pH to an appropriate pH set value and to minimize or eliminate the deviation between these values by using at least one of the following variables:

Length of time pulp suspension remains in reactor $\mathbf{12}_x$;

Pulp suspension feed rate,

Pressure of the carbon dioxide;

Temperature of the pulp suspension and/or the calcium hydroxide,

Pressure in reactor $\mathbf{12}_x$;

Temperature of the $CO_2$;

Pressure of the $CO_2$;

Concentration of the $CO_2$ in the medium;

Concentration of the CaO, the $Ca(OH)_2$, and the fibers; and

Specific surface area of the pulp fibers.

Figure 1A:
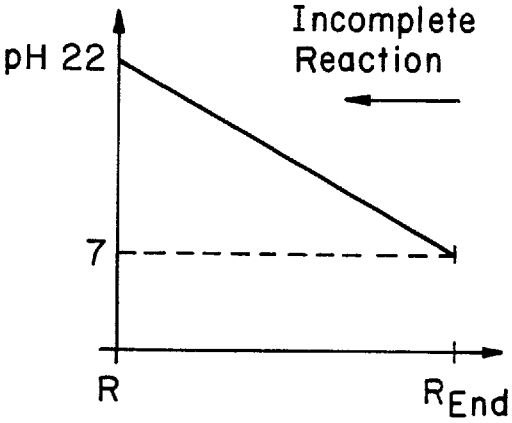
FIGS. 1*a*–1*c* illustrate various pH curves over the reaction time during a loading process.
Figure 1B:
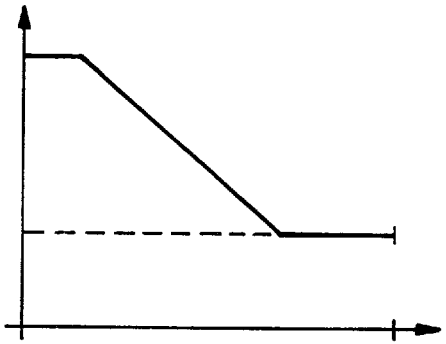
Figure 1C:
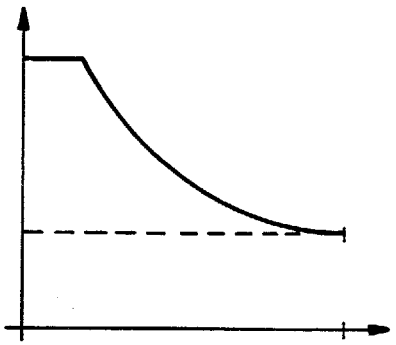

In FIGS. 1*a*–1*c*, the pH values for various examples are depicted throughout respective reaction times.

Figure 2:
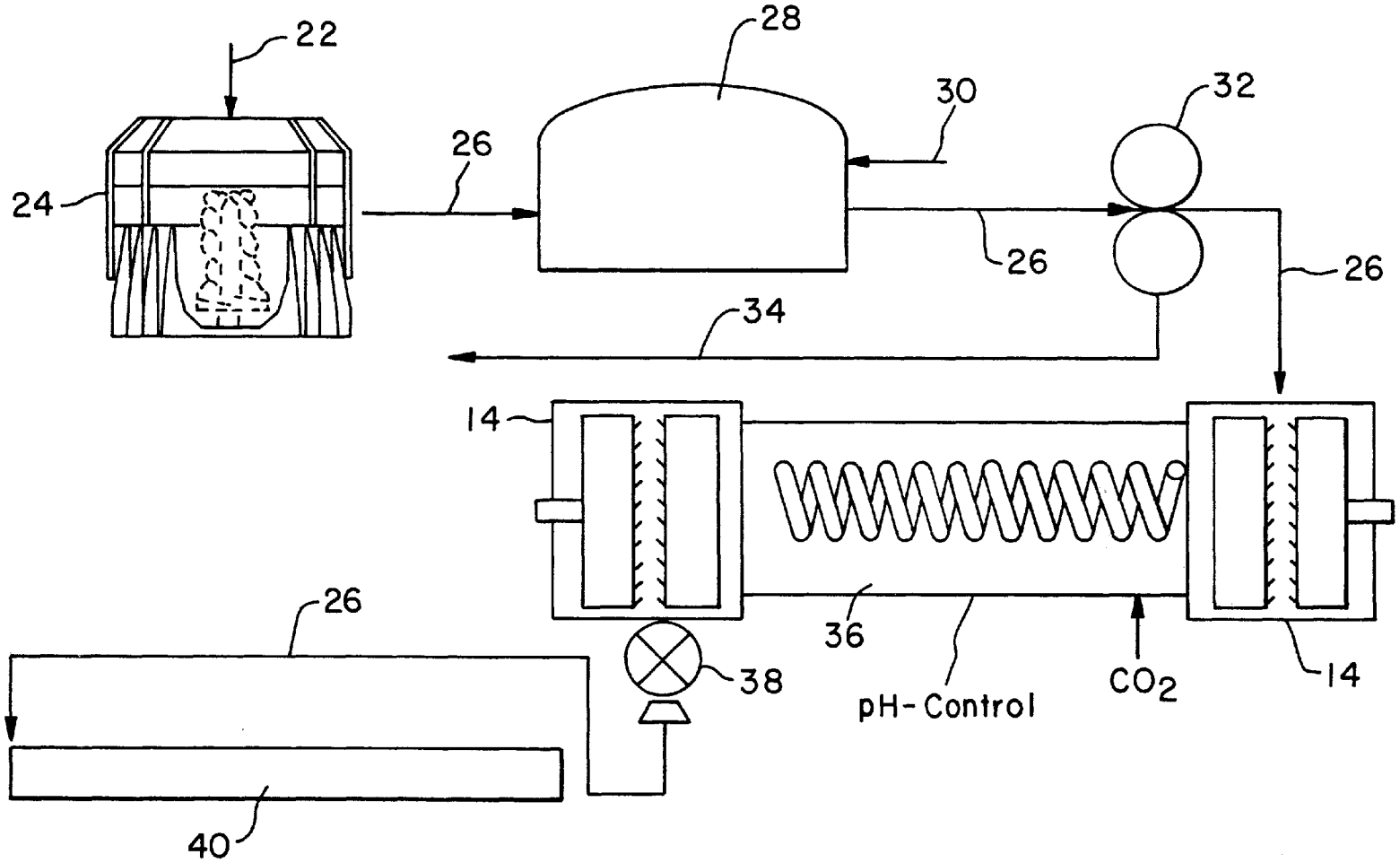
FIG. 2 is a schematic drawing of another embodiment of an apparatus for loading fibers.

Control of pH is also possible with the alternate apparatus design shown in FIG. 2. According to FIG. 2, pulp-starting material 22 is processed in a pulper 24 into a fibrous material 26 in which the fibers are already isolated (i.e., separated from each other) to at least a significant degree. Fibrous material 26 contains at least some water, which may be present between the fibers, in the internal spaces (lumen) and in the walls of the hollow fibers. Fibrous material 26 may also take the form of a so-called "dewatered crump pulp," for example (e.g., U.S. Pat. No. 5,223,090).

Fibrous material 26 is finally fed into a collection container 28 or other similar vessel. A calcium-rich medium 30 containing calcium oxide and/or calcium hydroxide (slaked lime) is also added to collection container 28 so that a portion of this associates with the water present in the fibrous material (between the fibers, in the hollow fibers, and in their walls). The following and previously mentioned chemical reaction begins:

$$\underset{\text{lime slaking}}{CaO + H_2O} \longrightarrow \underset{\text{slaked lime}}{Ca(OH)_2}$$

Immediately following the reaction, the fibrous material's dry content can be increased by feeding it through a press 32, whose power water 34, for example, is led back into the closed loop. In reactor 36, which is isolated by two fluffers 14, fibrous material 26 is charged with pure carbon dioxide or a medium containing carbon dioxide, as schematically indicated in FIG. 2 with the labeled arrow pointing into reactor 36. Upon being charged, fibrous material 26 is released through valve 38 to paper machine 40.

The charging of the fibrous material (previously processed as described above) with pure carbon dioxide or a medium containing carbon dioxide starts the following, previously-mentioned chemical reaction:

$$\text{"Fiber Loading}^{TM}\text{"}: Ca(OH)_2 + CO_2 \longrightarrow CaCO_3 + H_2O$$

(calcium carbonate + water)

Regardless of the type of apparatus used, the following measures or characteristics, whether implemented individually or in combination with each other, are advantageous with regards to further optimization of the "Fiber Loading™" process.

The pulp suspension's pH can be measured for the purpose of monitoring and/or controlling the chemical reaction. It is preferable for the pH to be variable within a range of about 5.5 to about 10.5.

The pulp suspension's ash content is variable within a range from about 1% to about 70%.

Carbon dioxide is preferably added in a gaseous state. The temperature of the added carbon dioxide is variable within a range of about −10° C. to about 250° C.

Visual characteristics, such as brightness, light scattering properties, opacity, color location, and the light diffusion coefficient may be employed as indicators for control of the chemical reaction.

While controlling the chemical reaction, it is fundamentally possible to also employ pH, ash content and/or the proportion of calcium carbonate ($CaCO_3$) as variables.

In the areas of FIG. 1 labeled with "VD", dilution (with $H_2O$) is also possible.

The following measures or characteristics, whether employed individually or in a desired combination, can promote further optimization of the Fiber Loading™ process:

Addition of pulp:

- Volume and mass flow rate are controllable;
- Temperature is controllable within a range of about 5° C. to about 95° C.;
- Material density is controllable within a range of about 15% to about
- 40%, preferably from about 20% to about 25%; and
- pH is controllable from about 10 to about 13;

Calcium carbonate (CaCO) in the reactor:

- Crystal types: rhombohedral, scalar, rosette, spherical, needle-shaped, prism-shaped, aragonitic, flat shaped, GCC, and other similar crystalline forms;
- Reaction under pressure (about 0.1 to about 20 bar);
- Temperature from about −10° C. to about 200° C.; and
- Dwell time from about 1 minute to about 1 hour;

Fluffing:

- Enlarges the specific surface area;
- Can be employed before, after and/or in a reactor or reactors;
- Have a dissociation width from about 0.1 to about 100 mm, such a width preferably being adjustable;
- Permit addition of energy within a range of about 5 kWh/t to about 200 kWh/t;

Refining:

- Before, after, in a reactor or reactors, and/or during the "Fiber Loading™" process;

Pressure vessel or reactor (*)/dwell pulper after reactor (**):

- (*) Crystal types: rhombohedral, scalar, rosette, spherical, needle-shaped, prism-shaped, aragonitic, plate-shaped, GCC, and other similar crystalline forms;
- (*) Reaction under about 0.1 bar to about 20 bar pressure;
- (**) Temperature within the range of about −10° C. to about 250° C.;
- (*) pH adjustable from about 5.5 to about 10.5;
- (**) Material density of about 0.1% to about 15%;
- (**) Addition of $CO_2$; and
- (**) Dwell time; and $CaCO_3$ proportion of the pulp:

- With an underlying percentage by mass of about 1% to about 70% of the filling material, about 1% to about 60% filling material being deposited onto the fibers and the remaining being free FLPCC™ (Fiber Loaded Precipitated Calcium Carbonate) in the suspension.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A chemical process of loading calcium carbonate into fibers, the fiber being contained in a pulp suspension, said chemical process comprising the steps of:

providing a pulp suspension of greater than five percent (5%) consistency and a calcium-rich medium, said calcium-rich medium containing at least one of calcium oxide and calcium hydroxide;

adding said calcium-rich medium to said pulp suspension to form a calcium-rich pulp suspension;

providing at least one reactor, each reactor having a source of a carbon-dioxide medium connected thereto, said carbon-dioxide medium being comprised of one of pure carbon dioxide and a medium containing carbon dioxide, said carbon-dioxide medium having a medium temperature associated therewith, said medium temperature being at least one of adjustable and controllable within an approximate range of −10° C. to 250° C.;

charging said calcium-rich pulp suspension and said carbon-dioxide medium into said at least one reactor, said calcium-rich pulp suspension and said carbon-dioxide medium thereby causing a chemical reaction in a carbon dioxide rich atmosphere to form calcium carbonate and water; and controlling a pH of at least one of said pulp suspension and said calcium-rich pulp suspension.

2. The chemical process of claim 1, further comprising the steps of:

measuring an actual pH of said at least one of said pulp suspension and said calcium-rich pulp suspension;

comparing the actual pH with a respective set point and determining an amount of deviation therebetween; and one of minimizing and eliminating said amount of deviation between the actual pH and the respective set point through use of at least one of the following variables:

length of time said calcium-rich pulp suspension remains in each said reactor;

feed rate of at least one of said pulp suspension and said calcium-rich pulp suspension;

pressure of the carbon-dioxide medium;

temperature of at least one of said pulp suspension, said calcium-rich pulp suspension and said calcium-rich medium;

pressure inside each said reactor;

temperature of said carbon-dioxide medium;

concentration of carbon dioxide in said carbon-dioxide medium;

concentration of at least one of said calcium-rich medium and said fibers; and specific surface area of said fibers.

3. The chemical process of claim 1, wherein the pH of at least one of said pulp suspension and said calcium-rich pulp suspension is controllable within a range of about 5.5 to about 10.5.

4. The chemical process of claim 1, wherein each of said pulp suspension and said calcium-rich pulp suspension have an ash content associated therewith, said ash content of at least one of said pulp suspension and said calcium-rich pulp suspension being controllable within a range of about 1% to about 70%.

5. The chemical process of claim 1, wherein said carbon-dioxide medium is added in a gaseous state.

6. The chemical process of claim 1, wherein the pH of said at least one of said pulp suspension and said calcium-rich pulp suspension is measured at least one of before, during and after the chemical reaction.

7. The chemical process of claim 1, wherein the pH of said at least one of said pulp suspension and said calcium-rich pulp suspension is measured at multiple intervals throughout the chemical process.

8. The chemical process of claim 1, wherein the pH of said calcium-rich pulp suspension is measured at the end of the chemical reaction.

9. The chemical process of claim 1, wherein pressure inside each said reactor is controlled within a range of about 0.1 bar to about 20 bar.

10. The chemical process of claim 1, comprising the further step of subjecting at least one of said pulp suspension and said calcium-rich pulp suspension to shearing forces.

11. The chemical process of claim 10, wherein each said reactor has at least one fluffer associated therewith, said shearing forces being provided by said at least one fluffer.

12. A chemical process of loading calcium carbonate into fibers, the fibers being contained in a pulp suspension, comprising the steps of:

providing a pulp suspension of greater than five percent (5%) consistency and a calcium-rich medium, said calcium-rich medium containing at least one of calcium oxide and calcium hydroxide;

adding said calcium-rich medium to said pulp suspension to form a calcium-rich pulp suspension;

providing at least one reactor, each reactor having a source of a carbon-dioxide medium connected thereto, said carbon-dioxide medium being comprised of one of pure carbon dioxide and a medium containing carbon dioxide;

charging said calcium-rich pulp suspension and said carbon-dioxide medium into said at least one reactor, said calcium-rich pulp suspension and said carbon-dioxide medium thereby causing a chemical reaction in a carbon dioxide rich atmosphere to form calcium carbonate and water;

controlling a pH of at least one of said pulp suspension and said calcium-rich pulp suspension; and using at least one visual characteristic of said calcium-rich pulp suspension in said reactor as an indicator for the progression of the chemical reaction in each said reactor, each said visual characteristic being one of brightness, light scattering properties, opacity, color and light dispersion coefficient.

13. A chemical process of loading calcium carbonate into fibers, the fibers being contained in a pulp suspension, comprising the steps of:

providing a pulp suspension of greater than five percent (5%) consistency and a calcium-rich medium, said calcium-rich medium containing at least one of calcium oxide and calcium hydroxide;

adding said calcium-rich medium to said pulp suspension to form a calcium-rich pulp suspension;

providing at least one reactor, each reactor having a source of a carbon-dioxide medium connected thereto, said carbon-dioxide medium being comprised of one of pure carbon dioxide and a medium containing carbon dioxide;

charging said calcium-rich pulp suspension and said carbon-dioxide medium into said at least one reactor, said calcium-rich pulp suspension and said carbon-dioxide medium thereby causing a chemical reaction in a carbon dioxide rich atmosphere to form calcium carbonate and water;

measuring a pH of at least one of said pulp suspension and said calcium-rich pulp supension upon enlarging the specfic surface area of said fibers; and controlling said pH of at least one of said pulp suspension and said calcium-rich pulp suspension.

* * * * *

UNITED STATES PATENT AND TRADEMARK OFFICE

CERTIFICATE OF CORRECTION

PATENT NO. : 6,537,425 B2
DATED : March 25, 2003
INVENTOR(S) : Rheims et al.

It is certified that error appears in the above-identified patent and that said Letters Patent is hereby corrected as shown below:

Column 3,
Line 41, delete "furst"; and substitute therefore -- first --.

Column 5,
Lines 48 and 49, delete the following:
"15% to about
40%, preferably from about 20% to about 25%; and"; and substitute therefore the following:
-- 15% to about 40%, preferably from about 20% to about 25%; and --.

Signed and Sealed this

Twenty-seventh Day of July, 2004

JON W. DUDAS
*Acting Director of the United States Patent and Trademark Office*